US007604581B1

(12) United States Patent
Williams

(10) Patent No.: US 7,604,581 B1
(45) Date of Patent: Oct. 20, 2009

(54) ABDOMINAL EXERCISE DEVICE

(76) Inventor: Phillip N. Williams, 210-B Cedar Ridge, Suite 207, Duncanville, TX (US) 75116

( * ) Notice: Subject to any disclaimer, the term of this patent is extended or adjusted under 35 U.S.C. 154(b) by 0 days.

(21) Appl. No.: 11/595,109

(22) Filed: Nov. 10, 2006

(51) Int. Cl.
*A63B 26/00* (2006.01)

(52) U.S. Cl. ..... 482/140; 446/220

(58) Field of Classification Search ..... 482/140, 482/148, 907, 142; 294/82.1, 26, 83.4; 43/5
See application file for complete search history.

(56) References Cited

U.S. PATENT DOCUMENTS

| | | | | |
|---|---|---|---|---|
| 2,887,948 | A * | 5/1959 | Kramer et al. | 100/213 |
| 3,785,642 | A * | 1/1974 | Sterlicchi | 482/51 |
| 3,986,287 | A * | 10/1976 | Arteaga | 43/5 |
| 4,257,589 | A | 3/1981 | Outlaw | |
| 4,824,105 | A | 4/1989 | Goldenberg | |
| 5,577,987 | A | 11/1996 | Brown | |
| 5,735,776 | A * | 4/1998 | Swezey et al. | 482/91 |
| 6,030,323 | A | 2/2000 | Fontenot et al. | |
| 6,068,580 | A * | 5/2000 | Myers et al. | 482/93 |
| 6,146,343 | A * | 11/2000 | Stewart | 601/118 |
| 6,260,897 | B1 * | 7/2001 | Carano | 294/26 |
| 6,461,284 | B1 * | 10/2002 | Francavilla | 482/142 |
| 6,547,703 | B1 * | 4/2003 | Swezey et al. | 482/91 |
| 6,663,546 | B2 | 12/2003 | Kallassy | |
| 7,341,548 | B2 * | 3/2008 | Heitzman et al. | 482/142 |
| 2001/0001094 | A1 * | 5/2001 | Panes | 482/93 |
| 2004/0002413 | A1 | 1/2004 | Wimber | |
| 2004/0102296 | A1 | 5/2004 | Dubrul et al. | |
| 2004/0235626 | A1 | 11/2004 | Acher | |
| 2005/0009670 | A1 | 1/2005 | Scafidel | |
| 2005/0049527 | A1 | 3/2005 | Green | |
| 2005/0124474 | A1 | 6/2005 | Van Der Hoeven | |

OTHER PUBLICATIONS

Metroactive, Sphere Factor, Metro Santa Cruz , Jul. 27, 2005, 5 pages.
Abdominal Exercises, Swiss Balls, Internet Printout, undated, 4 pages.
Wanyu Industry & Trade Co., Ltd,. Yongkang, 6 Second ABS Abdominal Slide, Undated, 1 page.

* cited by examiner

*Primary Examiner*—Lori Amerson
(74) *Attorney, Agent, or Firm*—Roger N. Chauza, PC

(57) ABSTRACT

An exercise device (10) having a frame (12) with a base member (30) and a handle member (20). The base member (30) includes spaced-apart cage members (32, 34) with respective curved midsections (40, 42) for holding a ball (14) therebetween in a deformed manner. The frame (12) also includes a handle member (20) with curved portions thereof which define handles (16, 18) for gripping by the user. The midsection of the handle member (20) has a curved portion (28) which forms a stop against which the deformed ball (14) abuts.

17 Claims, 5 Drawing Sheets

ABDOMINAL EXERCISE DEVICE

TECHNICAL FIELD OF THE INVENTION

The present invention relates in general to physical exercise methods and apparatus, and more particularly to the field of abdominal exercise devices and equipment.

BACKGROUND OF THE INVENTION

The physical well being of a person is necessary to the longevity and enjoyment of life. A well balanced diet and physical exercise is important to the maintenance of a healthy body. A person can exercise the muscles and other organs of his/her body with or without the use of exercise equipment and devices. People have exercised various muscle groups of the body by walking, running, conducting isometric exercises, and other physical exercises such as sit-ups, deep knee bends, crunches, etc., all of which are beneficial. However, the use of equipment often facilitates the exercise of particular muscles, and also provides the user with an impetus for long term use thereof so as to obtain the optimum benefit.

A group of muscles of special importance to people in general is the abdominal group of muscles, including the upper and lower abdominal muscles, a well as the set of oblique muscles. This group of muscles is often highlighted by exercise enthusiasts because such group of muscles is readily observable, especially if the midriff portion of the body is exposed. Even if not exposed, a well proportioned abdominal musculature is nevertheless very apparent from outward appearances. Sit-ups have been a staple for persons desiring to trim and tone the abdominal muscles. More recently, abdominal crunches have been highlighted and emphasized to better sculpt and tone the abdominal muscles. To that end, there are a host of devices adapted for assisting a person to carry out abdominal crunches. One device is disclosed in U.S. Pat. No. 5,577,987. These devices are somewhat portable and are generally cost effective for the home exerciser. Other exercise systems of the professional type may incorporate exercises for the abdominal muscles, but such systems are very expensive, not portable and require substantial room or space to accommodate the same.

There are yet other abdominal exercise devices which are hand-held devices that are pressed against the abdominal muscles during crunch-type exercises. One such device is illustrated in published U.S. Patent Application No. 2005/0124474. The device includes handles for holding by the user to press a tensioned member against the abdominal muscles. In practice, a heavy duty elastomeric band is used to provide the tension to the member which is pressed against the abdominal muscles. The pressure exerted on the abdominal muscles is a function of how hard the user compresses the tensioned member against his/her abdominal muscles during a crunch exercise.

A more popular abdominal exercise involves the use of a large inflated ball, such as a Swiss ball. A person lays on the ball, with the ball located under the lower part of the person's back, also with the person's feet on the floor. The exercise involves lifting the upper trunk of the body, much like a crunch, to stretch and strengthen the abdominal muscles.

From the foregoing, it can be seen that a need exists for an abdominal exerciser device that is cost effective, light weight and portable, is user friendly and is very effective in shaping and sculpting the abdominal and other muscles of the body.

SUMMARY OF THE INVENTION

In accordance with the principles and concepts of the invention, there is disclosed an exercise device including a frame for supporting a resilient object, such as a ball, where the frame has handles for gripping by a user of the device so that the resilient object can be pressed against the part of the user's body to be exercised.

In accordance with another feature of the invention, the frame of the exercise device is shaped to cage a spherical object and maintain the object captured in such a manner that a portion of the resilient object is exposed for pressing against the body of the user. The frame includes handles for grasping by the user.

In accordance with another aspect of the invention, the exercise device includes a base member having spaced apart cage members so that a ball can be inserted or inflated, and squeezed therebetween. A transverse member provides a stop against which the ball is pushed into the frame, both during inflation/insertion of the ball, and during exercising muscles when the user pulls the frame toward the body part to be exercised.

In accordance with a method of use of the invention, disclosed is an exercise device which includes a frame holding a resilient object, where the frame is grasped by the user. The user pulls the frame toward the body part to be exercised so that the resilient object is pressed against the desired muscles. When used to tone or strengthen abdominal muscles, the user lies on the floor or other type of platform, and lifts the upper part of the body upwardly and at the same time pulls the exercise device against the abdominal muscles, to perform crunch-type exercises. The abdominal muscles are thereby toned and strengthened.

In accordance with one embodiment of the invention, disclosed is an exercise device which includes an object with resilient properties so as to be deformable. The exercise device further includes a hand-held frame having opposing handles for gripping by a user of the device. The frame is adapted for attaching thereto the resilient object. The handles each have a longitudinal axis, where the axes of the handles are located in a plane. The plane in which the handles are disposed also intersects the resilient object. The user can then grip the handles and pull the deformable object against the user's body for optimum effect.

In accordance with another embodiment of the invention, disclosed is an exercise device which includes a resilient ball and a frame having opposing hand grips adapted for gripping by a user of the device. The frame includes means for attaching the ball thereto so that at least a portion of the ball is exposed for pushing against a body part of the user.

In accordance with a method of using the invention, disclosed are the steps of grasping opposed handles of an exerciser device, pulling the exercise device toward the abdomen of the person, and causing the movement of the frame to compress a resilient ball against the abdomen of the person.

BRIEF DESCRIPTION OF THE DRAWINGS

Further features and advantages will become apparent from the following and more particular description of the preferred and other embodiments of the invention, as illustrated in the accompanying drawings in which like reference characters generally refer to the same parts, functions or elements throughout the views, and in which.

DETAILED DESCRIPTION OF THE INVENTION

Figure 1:
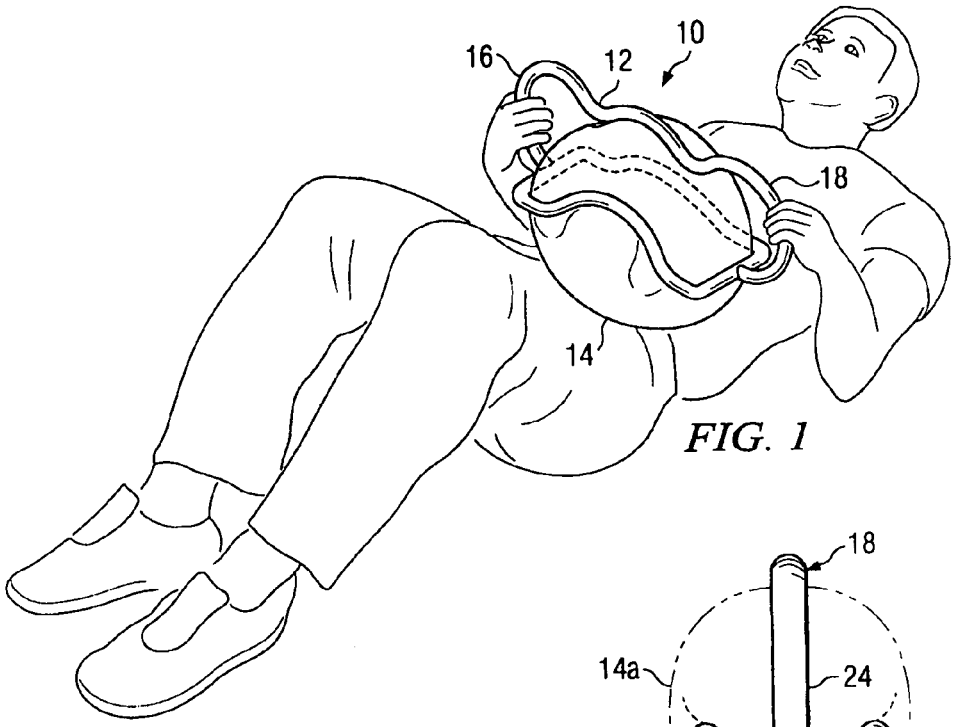
FIG. 1 is an isometric view of a typical use of the exercise device according on one embodiment.

In the ensuing description of the various embodiments of the invention, it should be understood that the terms "horizontal," "vertical," "top" and "bottom" are meant to mean orientations when the exercise devise is disposed as shown in FIG. 1, namely when located over the body of a person lying in a supine position generally on a horizontal platform. However, the use of the exercise device of the invention is not limited to the orientation of either the person described above or the exercise device itself.

With reference to FIG. 1, there is shown the preferred manner in which a person uses the abdominal exercise device 10 constructed according to one embodiment of the invention. The exercise device 10 includes a frame 12 for holding a resilient object, such as an inflatable ball 14. The frame 12 is formed or otherwise constructed with one or more tubular members to define a closed structure for caging or otherwise holding the ball 14 in a secure manner. The frame 12 includes opposed handles 16 and 18 for grasping by the user to pull the exerciser device 10 toward his/her abdominal muscles while carrying out crunch exercises. The repetitious pulling of the flexible ball 14 against the abdominal muscles during the crunch exercises is effective to strengthen such muscles.

Figure 3:
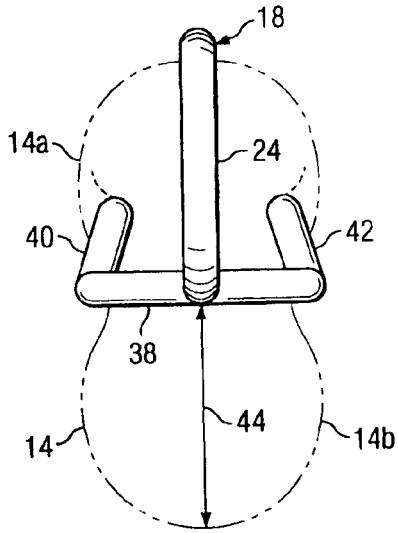
FIG. 3 is a side view of the exercise device of FIG. 2, showing the upper and lower lobes of the deformed ball.
Figure 2:
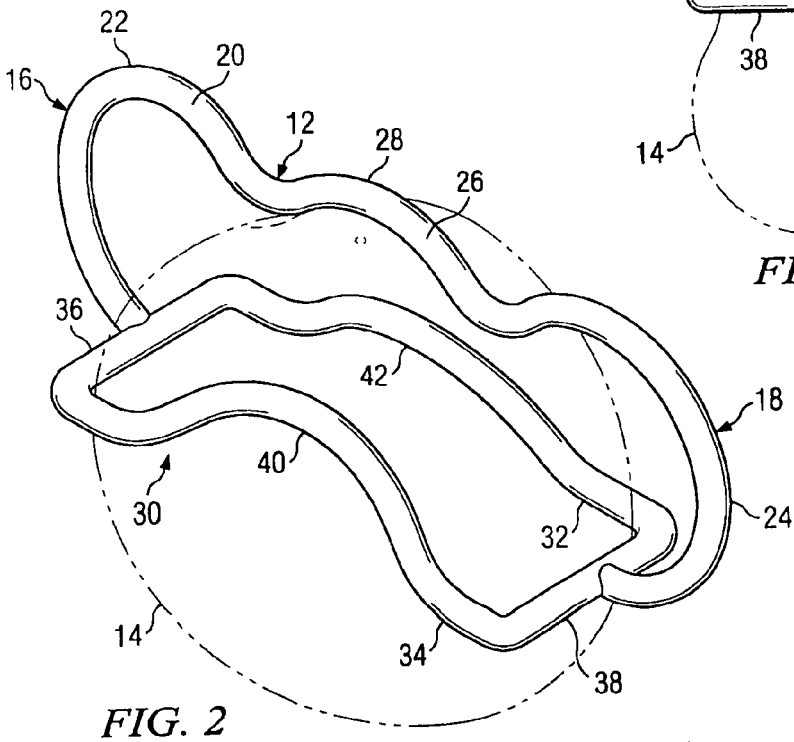
FIG. 2 is an isometric view of the frame of the exercise device of the invention, with the ball shown in phantom.

With reference to FIGS. 2 and 3, there is illustrated the detailed construction of the frame 12 of the exercise device 10, and the manner in which the ball 14 is held by the frame 12. The frame 12 is preferably constructed with tubular brushed aluminum, or a PVC type of plastic, although other materials can be employed, including solid materials. In addition, the frame 12 of the exercise device 10 can be made as a single unitary member, or as multiple members adhered, welded or bolted together. Indeed, those skilled in the art may find that the frame 12 can be made with a shape or form different from that disclosed.

According to one embodiment, the frame 12 is constructed with a handle member 20 and a base member 30. The handle member 20 is constructed with opposing handles 16 and 18. The handles 16 and 18 have curved portions 22 and 24 for grasping by the user. The curved portions 22 and 24 provide a space from the ball 14 for easy grasping by the user. The handles 16 and 18 are positioned as to be vertical when the user is lying on the floor. The curved nature of the handles 16 and 18 help prevent the user's hands from slipping down on the frame 12 when the ball 14 is compressed against the body of the user. A transverse portion 26 of the handle member 20 connects the curved portions 22 and 24 together. In addition, the transverse portion 26 of the handle member 20 has a curved midsection 28. As will be described in more detail below, the transverse portion 26 of the handle member 20 provides a part of a cage for containing the ball 14 which is captured within the frame 12. The curved midsection 28 of the transverse portion 26 conforms to the spherical surface of the ball 14 and assists in maintaining the ball 14 laterally centered within the frame 12. Alternatively, the curved midsection 28 of the transverse portion 26 could be a straight member connecting the curved handles 16 and 18 together and for caging the ball 14 within the frame 12.

The frame 12 further includes the base member 30 to which the handle member 20 is attached. The base member 30 is constructed with spaced-apart transverse cage members 32 and 34. The cage members 32 and 34 are attached at the ends thereof to respective side members 36 and 38. Each cage member 32 and 34 includes a respective curved midsection 40 and 42. The curved midsections 40 and 42 are oriented toward the transverse portion 26 of the handle member 20. The curved midsections 40 and 42 of the base member 30 and the curved midsection 28 of the transverse portion 26 of the handle member 20 function to capture the ball 14 and maintain the same in a deformed manner within the frame 12. Importantly, the ball 14 is captured in such a manner in the frame 12 so that a large portion of the ball 14 extends out of the bottom of the frame 12. This is an advantage so that the frame 12 can not be pressed against the body of the user, but only the resilient ball 14 is pushed against the body of the user. This is especially important during crunch exercises, when the user bends his/her body about the exercise device 10. In the preferred embodiment of the invention, the ball 14 is a conventional rubber kick ball about ten inches in diameter. About five inches of the ball 14 extends from the base member 30, as shown by arrow 44 in FIG. 3. The ball 14 preferably has a textured surface to minimize slipping on the body of the user.

In accordance with an important feature of the invention, the curved midsections 40 and 42 of the base member 30 are angled toward each other, as shown in FIG. 3. The curved midsections 40 and 42 of the base member 30 thus press into the ball 14 and deform the same so that the ball 14 balloons out partially around the curved portions 40 and 42. This ballooning of the ball 14 around the transverse cage members 32 and 34 maintains the ball 14 caged within the frame 12 and prevents the ball 14 from becoming dislodged from the frame 12 during pressing of the same against the body of the user.

In FIG. 3, the curved midsections 40 and 42 are shown deflected into the body of the ball 14. Also noted, the curved midsections 40 and 42 are angled inwardly toward each other. Each curved midsection 40 and 42 is angled about 70 degrees with respect to the side members 36 and 38. As shown, the ball 14 is maintained in a distorted shape due to the base member 30 and the curved midsections 40 and 42 thereof, as well as the transverse portion 26 of the handle member 20. As seen from the side, the ball 14 is ballooned out in the form having two lobes, namely top lobe 14*a* and bottom lobe 14*b*. The lobe 14*b* protruding from the frame 12 includes a rounded surface adapted for pressing against the body of the user. The bottom lobe 14*b* is not spherical in shape, but rather has a lateral width (across the abdomen) greater than the orthogonal dimension (up/down the abdomen) thereof. This allows the person to perform crunches or other abdominal exercises with the torso in the proper position. Importantly, the bottom lobe

14*b* of the ball 14 pressed against the abdominal muscles during crunch-type exercises prevents the person from lifting his/her torso too far with too much forward movement, thereby helping the person to carry out crunches properly.

The ball 14 is inserted into the frame 12 and then inflated until the ball 14 is ballooned out against the frame 12, and distorted in the form as shown. Alternatively, in some instances the ball 14 can be inserted into the frame 12 when fully or partially inflated.

The exerciser device 10 is used in the following manner. When lying on a floor or other surface, the user simply grasps the handles 16 and 18 and positions the bottom lobe 14*b* of the ball 14 adjacent the abdominal muscles, as shown in FIG. 1. The person then applies firm pressure of the ball 14 against the abdomen and raises the upper part of the body off the floor while maintaining the frame 12 steady. The bottom lobe 14*b* of the ball 14 may deform somewhat as the person raises the upper part of the body off of the floor. The upper part of the body is repeatedly raised off the floor and lowered onto the floor while the lobe 14*b* of the ball 14 is pressed against the abdomen. This repeated movement exercises the abdominal muscles and strengthens the same. One advantage of the abdominal exerciser device 10 is that as the person attempts to raise the upper torso, his/her hands will automatically pull down on the handles 16 and 18 of the frame 12, thereby pressing the ball 14 against the abdominal muscles and providing a resistance against the muscles. As noted above, this strengthens such muscles. In addition, the downward pressure applied to the abdominal muscles by the exerciser device 10 enables the person to maintain his/her midsection in contact with the floor, exercise table or platform. The ball 14 pressed against the abdomen of the user assists in maintaining the proper posture of the person carrying out the crunch. The firmness of the ball 14 can be adjusted as a function of the amount of inflation of the ball 14. The less inflated, the softer the ball 14, and vice versa. The greater the degree of inflation, the more pressure that is applied against the abdominal muscles during exercising.

In addition to the foregoing, the user can roll the frame 12 and thus the ball 14, left and right across the abdomen in an East/West direction during exercising, thereby increasing the area of pressure of the ball against the abdomen. The frame 12 can also be rotated by the user, toward the chest and then toward the hips in a North/South direction. The frame 12 can also be moved by the user so that the ball 14 effectively rolls in a circular path, or other path, across portions of the abdomen. Lastly, the frame 12 can be moved by the user so that the ball 14 is effectively bounced on the abdomen.

While FIGS. 1-3 illustrate the features of the preferred embodiment of the invention, those skilled in the art may find that the frame can be constructed without the curved midsection 28 in the transverse portion 26, and/or without the curved midsections 40 and 42 in the base member 30. The curved midsections 40 and 42 shown in FIG. 3 could be changed from acute angles, as measured with respect to the side member 38, to ninety degree angles. Preferably, an inflatable ball 14 constructed of an elastomeric, rubber or synthetic plastic material is employed, as such type of object is easily obtainable and is relatively inexpensive. Balls having a diameter between about 10 inches to about 18 inches are suitable for use with the invention.

It is contemplated that balls inflatable with air are most desirable for use with the invention. However, balls constructed with a resilient core material, such as a spongy or porous core material, can also be used with equal effectiveness. The resilient object caged by the frame 12 need not be a spherical ball, but can be partially spherical with a bottom surface adapted for conforming to the contour of the person's abdomen. In other words, the object caged by the frame 12 can be spherical so as to be caged in the manner described above, but have a flatter bottom surface, or even an inwardly concave bottom surface adapted for contacting the abdomen.

Figure 4:
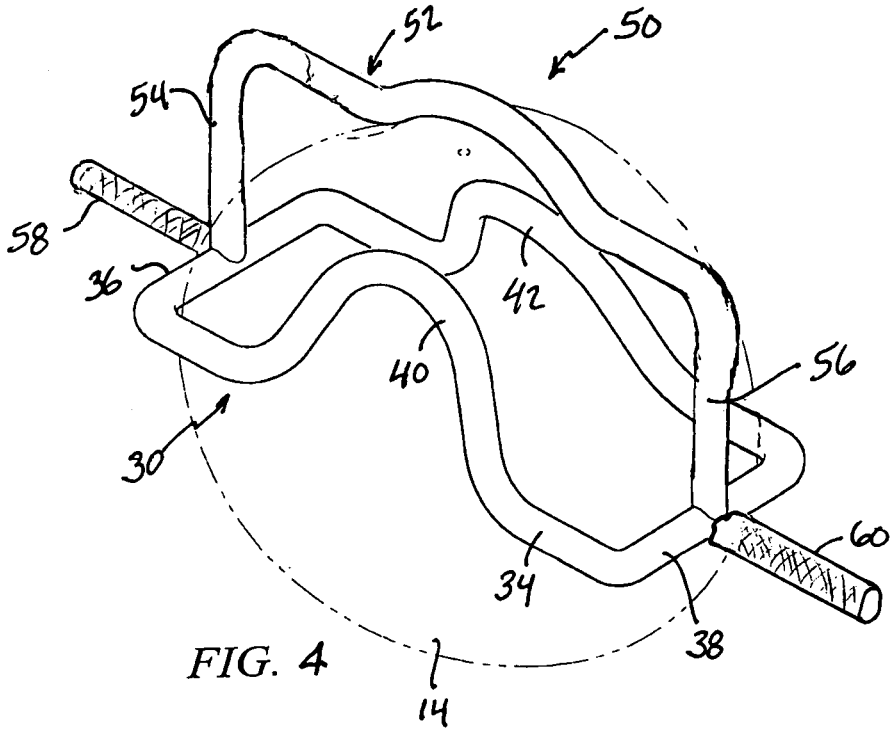
FIG. 4 is another embodiment of the exercise device according to the invention, constructed with radial handles.

FIG. 4 illustrates another embodiment of an exercise device 50 having a different handle configuration. Here, the transverse portion 52 does not have curved portions forming handles. Rather, the curved handle portions are replaced with generally linear tubular sections 54 and 56. If desired, the linear sections 54 and 56 can serve as vertically-oriented handles for grasping by the user of the exercise device 50. The exercise device 50 is equipped with radially-extending handles 58 and 60 attached to the side members 36 and 38 of the base member 30. The base member 30 can otherwise be constructed in a manner similar to that described above in connection with FIGS. 2 and 3. The ball 14 is captured in the frame as shown, with portions thereof ballooned out so as to be captured in the frame.

When radially extending handles 58 and 60 are employed, it is preferable that the frame be constructed of tubular metal so that the handles can be welded to the respective side members 36 and 38 of the base member 30. The radial handles 58 and 60 can be knurled or otherwise fitted with a rubberized covering to facilitate gripping by the user. Alternatively, the exerciser device 50 shown in FIG. 4 could retain the same frame 12 shown in FIG. 1, with the addition of the radial handles 58 and 60.

Figure 5:
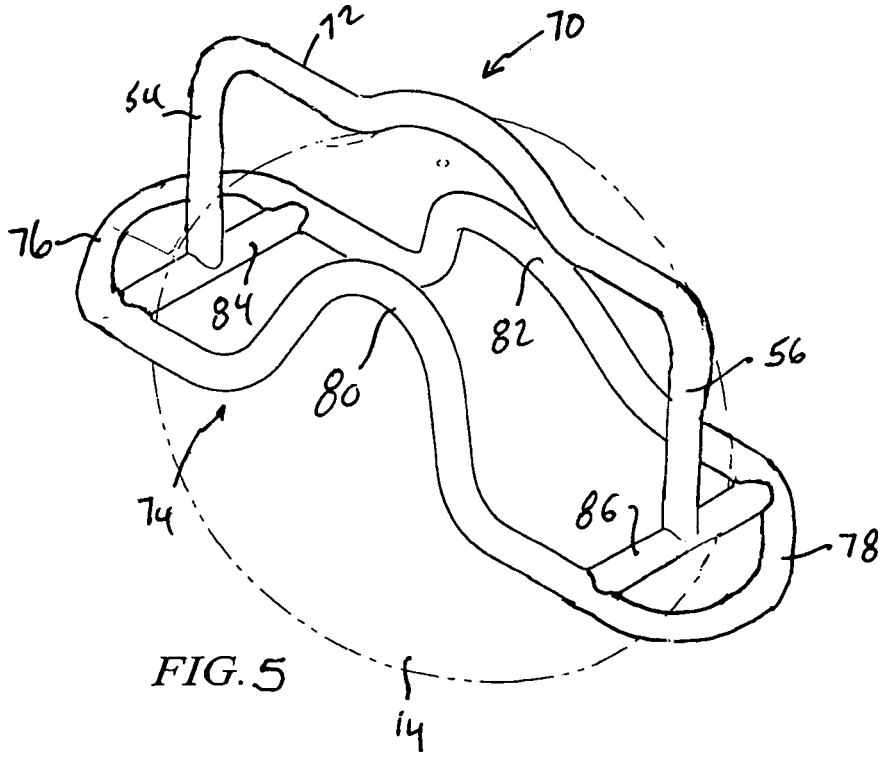
FIG. 5 is another exercise device according to yet another embodiment of the invention, constructed with horizontally disposed curved handles.

FIG. 5 illustrates another frame for use with an exercise device 70. The frame includes a transverse portion 72 with linear sections 54 and 56 much like that shown in FIG. 4. However, the base section 72 includes curved horizontally-disposed handles 76 and 78. The curved handles 76 and 78 can be formed as part of the tubular stock used to form the base member 74. The ends of the transverse portion 72 can be welded to respective side members 84 and 86, the latter of which can be welded between the spaced apart tubular members of the base member 74. The base member 74 can be constructed so that the curved handles are also curved downwardly, even to an extent of ninety degrees from the horizontal.

Figure 6:
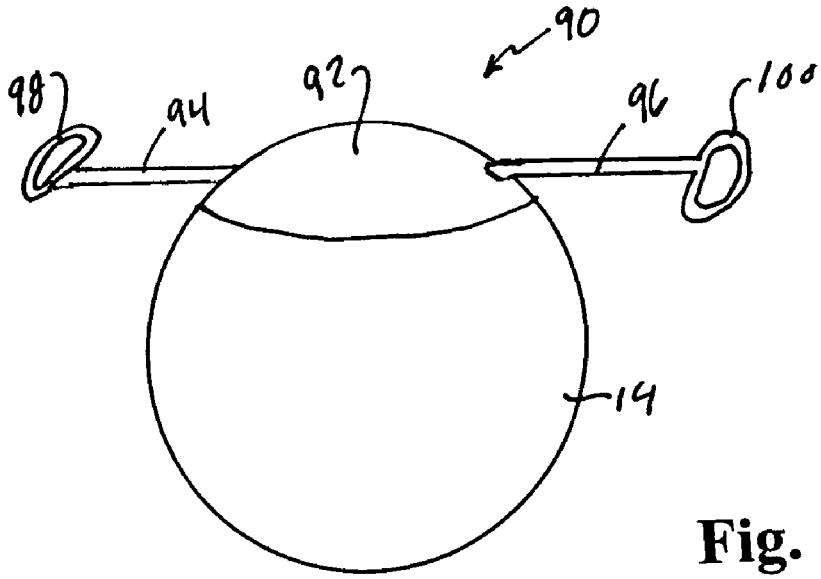
FIG. 6 is an isometric view of another embodiment of the invention, employing a dish to which a spherical ball is attached, where opposed handles are attached to the dish.

FIG. 6 illustrates an exercise device 90 according to another embodiment. Here, the exercise device 90 includes a rigid dish 92 to which opposed arms 94 and 96 are attached, such as by welding. As an alternative, the dish 92 and the arms 94 and 96 can be molded as a unitary member using plastic, with suitable reinforcements to provide rigidity between the dish 92 and the arms 94 and 96. Alternatively, the arms 94 and 96 can be constructed as one member which extends through the dish 92. The ends of the arms 94 and 96 can themselves serve as radial handles for grasping by the user, or curved handles 98 and 100 can be attached to the ends of the arms 94 and 96, as shown.

A ball 14, or other resilient object, can be attached to the dish 92. It is envisioned that the ball 14 can be adhered to the inside surface of the dish 92 with a suitable adhesive. The ball 14 can be of the inflatable type, or of the type that has a spongy construction throughout the entire ball. The dish 92 can cover all or a portion of the top hemisphere of the ball 14. The bottom portion of the ball 14 is exposed so as to be available for pressing against the abdominal muscles of the user. The exercise device 90 is used to strengthen abdominal muscles in the same manner as described above.

Figure 7:
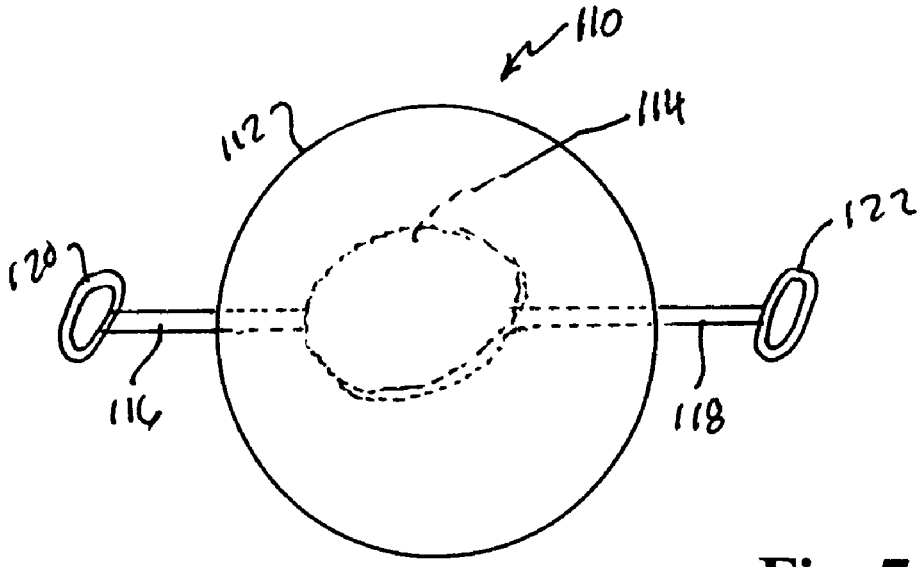
FIG. 7 is an isometric view of yet another embodiment of the invention, in which a disc is embedded in the ball, where the disc has handles extending therefrom outside the ball.

FIG. 7 illustrates another exercise device 110 employing a ball 112 constructed with a spongy core, i.e., of the type that is not inflatable. The ball 112 is formed over a disk 114 so as to adhere to the disk 114. The disk 114 is thus embedded within the material of the ball 114. The disk 114 is preferably of a planar construction, but need not be of such shape. Extending from the disk 114 are opposed arms 116 and 118. The arms 116 and 118 extend outside the outer surface of the ball 112. Attached to the ends of the arms 116 and 118 are respective handles 120 and 122. The handles are preferably oblong is shape and attached to the ends of the arms 116 and 118 so as to lie in the same plane as the disk 114. With this orientation of the handles 120 and 122, the user will position the exercise device 110 so that the disk 114 is also generally parallel to the abdomen. T-shaped handles could be used with similar results. This allows the force exerted by the user on the handles 120 and 122 to be transferred through the large area of the disk 114 and through the bottom portion of the ball 112 to the abdominal muscles of the user.

Figure 8:
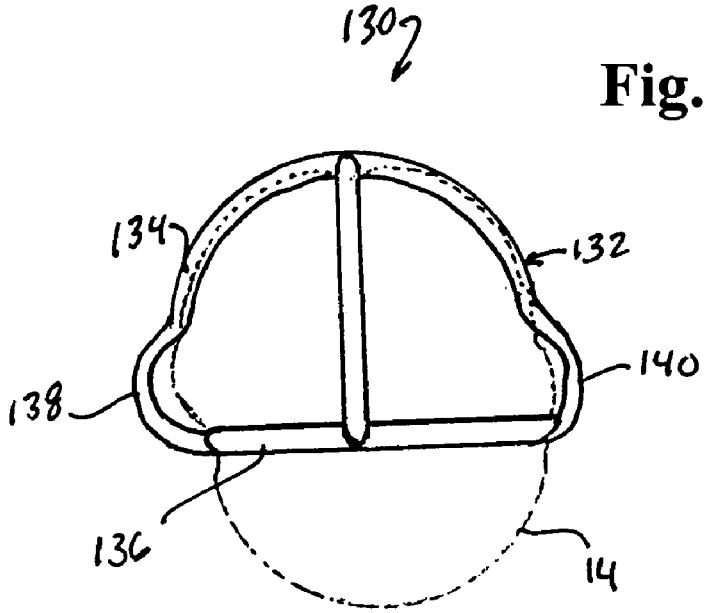
FIG. 8 is a frontal view of another embodiment of an exercise device constructed according to the invention.
Figure 9:
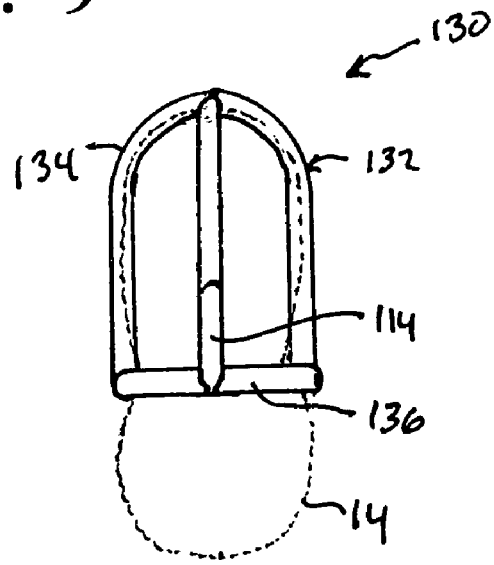
FIG. 9 is a side view of the exercise device of FIG. 8.

FIGS. 8 and 9 illustrate another embodiment of the invention. The exercise device 130 includes a frame 132 for holding a ball 14 therein, in a deformed manner. The frame 132 includes preferably four curved members 134 that are attached together at the upper ends thereof at the top of the frame 132. The lower ends of the curved members 134 are connected to an oblong or oval-shaped base member 136. The frame 132 is thus domed to accommodate securing of the ball 14 therein. Two opposing curved members 134 are constructed with outwardly directed curved handles 138 and 140. For flexibility, the other curved members 134 of the frame 132 could also be constructed with curved handles. However, it is preferable that the frame 132 include only two opposed handles so that other handles would not interfere with the person's body while performing crunches. The frame 132 can be molded as a unitary member using a plastic or other synthetic material, or by using aluminum tubing formed and welded at the ends thereof.

The dome-shaped frame 132 has a major diameter (FIG. 8) somewhat smaller than that of the ball 14, and a minor diameter (FIG. 9) about half that of the major diameter. With a frame 132 of such a shape, the ball 14 can be inflated in the frame 132 and maintained therein. The ball 14 is deformed around an annular band thereof at a location where the oval base member 136 is forced into the surface of the ball 14. When the ball 14 is inflated in the dome-shaped frame 132, the ball is deformed into two lobes, one inside the frame 132, and the other lobe extending from the bottom of the frame 132, as shown in FIGS. 8 and 9. The ball 14 may also balloon out between the curved members 134, which additionally facilitates capturing of the ball 14 within the dome-shaped frame 132. The breadth of the bottom lobe of the ball 14 (that extends from the frame 132) is of a greater dimension than the width. As noted above, this deformed shape of the ball 14 facilitates a properly performed crunch when the user bends the upper part of the body.

Figure 11:
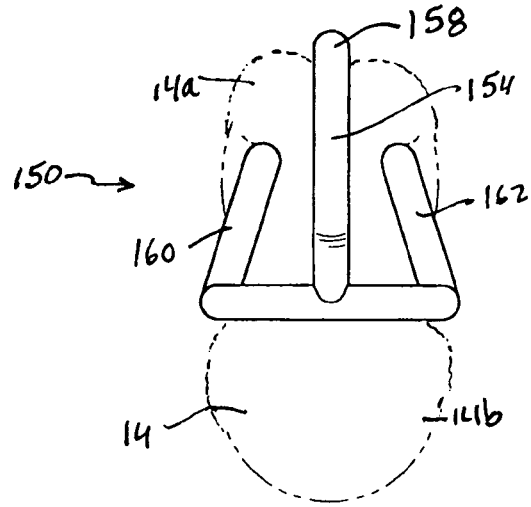
FIG. 11 is a side view of the exercise device of FIG. 10.
Figure 10:
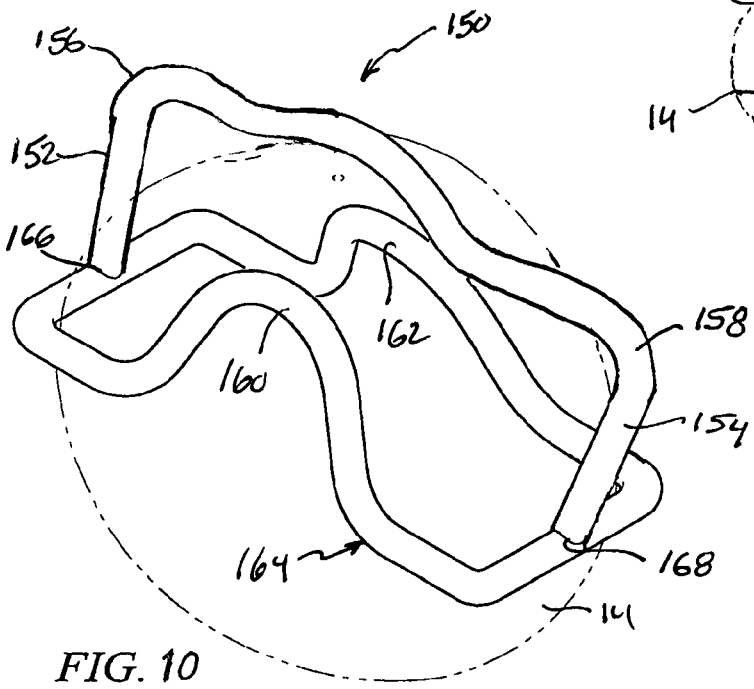
FIG. 10 is an isometric view of another embodiment of the exercise device of the invention.

FIGS. 10 and 11 illustrate an exercise device 150 constructed with a different handle configuration. In the exercise device 150, the handles 152 and 154 are constructed generally of linear sections extending upwardly to the curved corners 156 and 158. The linear handles 152 and 154 are each angled outwardly in opposite directions, between 5-15 degrees from a vertical reference. The handles 152 and 154 can be covered with a slip resistance material, such as a rubberized coating or other handle grip material well known in the art of instruments equipped with hand grips.

The midsections 160 and 162 of the base member 164 have pronounced curves, and are angled inwardly toward each other in the manner described above. This allows the ball 14 to be inflated within the frame of the exercise device 150 and captured so that it cannot become dislodged during use. When inflated, the ball 14 bulges out of the openings within the frame of the exercise device 150, as shown in FIG. 11. As noted in the drawings, the ball 14 is constrained from the top and opposing sides by the frame, thereby caging the same and preventing dislodgment. During use of the exercise device 150, the user grips the handles 152 and 154 while lying on a surface, and pulls the exercise device 150 into contact with his/her abdomen until the bottom portion 14*b* of the ball is compressed. The extent of compression of the bottom portion 14*b* of the ball 14 depends on the user's strength and the comfort desired by the user. Normal crunch exercises can then be conducted by the user to strengthen the abdominal muscles. When the exercise device 150 is pressed against the abdominal muscles in the manner noted above with the other embodiments, the correct posture of the user during crunches is better maintained, namely, the lower back of the user tends to remain in contact with the floor or platform, rather than being raised which degrades the result of the crunch exercise.

The frame of the exercise device 150 can be constructed of a tubular steel material, welded where the ends of the handle member joins the base member 164. This is shown as junctures 166 and 168. The base member 164 is preferably constructed as two identical sections, and joined together at the respective ends thereof, as by welding, at the junctures 166 and 168. During construction, one base member section is turned around and the ends thereof are welded to the ends of the other base member section at junctures 166 and 168. Then, the ends of the handle section can be welded to the junctures 166 and 168. Alternative, two steel tubular "T" connections (not shown) can be employed to join the ends of the base member sections together, as well as the end of the handle member, much like a plumber would use a copper T coupler to join one copper pipe to another at a ninety degree angle. The three ends of the tubular frame of the exercise device 150 can be welded to the T connection. One T connection would be used at each of the two junctures.

After assembly of the frame of the exercise device 150, it can be painted or otherwise coated with a protective and decorative coating. Preferably, the frame is powder coated with a paint and processed according to well known techniques to produce a glossy, durable and chip resistant finish. A standard kick ball having a roughened surface can be employed with the frame of the exercise device 150. A yellow-colored frame and a red or blue colored ball provides a distinctive and recognizable appearance.

While the foregoing describes the various embodiments in connection with the use of a ball, those skilled in the art may find that a spherical ball or other object is not necessary to the practice of the invention. First, the object held by the handles need only be resilient in the area that will be pushed against the body of the user. The other portions of the object held by the handles could be less pliable or even rigid. If adapted for being held by a pair of opposed handles, even a bean bag or other similar object could be suitable for use with the invention. Other resilient objects can also be used with the invention, including leaf or coil springs attached to a frame that deform when the springs are pressed against the muscle to be exercised.

While the preferred and other embodiments of the invention have been disclosed with reference to specific exercise device and method of use thereof, it is to be understood that many changes in detail may be made as a matter of engineering choices without departing from the spirit and scope of the invention, as defined by the appended claims.

What is claimed is:

1. An exercise device, comprising:

an object having resilient properties so as to be deformable; and a hand-held frame having opposing handles for gripping by a user of the device, where said opposing handles are immovable with respect to each other during use, said frame having rigid spaced apart members adapted for squeezing therebetween said deformable object during use and during nonuse by a user of the device and to contain said deformable object within said frame and prevent rotation of said deformable object, said hand-held frame constructed with a size and weight adapted to be grasped and held with said deformable object above a body of the user while lying in a supine position so that said deformable object can be repeatedly moved up and down against the body of the user, and said handles each having a longitudinal axis, and the axes of said handles are located in a plane, and said plane intersects said deformable object, whereby the user can grip the handles and pull the deformable object against the body of the user.

2. The exercise device of claim 1, wherein said resilient object is inflatable.

3. The exercise device of claim 2, wherein said resilient object is spherical in its rest state when not squeezed by said spaced apart members, and when the resilient object is squeezed by said spaced apart members said resilient object is deformed into two lobes.

4. The exercise device of claim 1, wherein said object is constructed with a deformable material uniformly therethrough, and said material is resilient.

5. The exercise device of claim 1, wherein said frame includes spaced-apart members for frictionally holding said resilient object therebetween in a deformed condition.

6. The exercise device of claim 1, wherein said frame is constructed to deform said resilient object into at least two lobes.

7. The exercise device of claim 1, wherein said frame is tubular.

8. The exercise device of claim 1, wherein said frame has opposing vertical portions for gripping by the user, and spaced-apart horizontal portions for holding said deformable object therebetween in a deformed condition.

9. The exercise device of claim 8, wherein said horizontal portions have sections angled toward each other to securely hold said resilient object therebetween.

10. An exercise device, comprising:

a resilient ball that is deformable;

a frame having opposing hand grips adapted for gripping by a user of the device, said frame including members spaced apart less than a diameter of said ball for compressing said ball to form two lobes so that at least one lobe of said ball is exposed for pushing against a body part of the user, said spaced apart members compressing said ball to prevent rotation thereof and to maintain deformation of the ball into the two lobes when the ball is not compressed against the body of the user; and wherein said ball is inserted and captured in a compressed manner between said spaced apart members, at least a portion of said ball protruding from said spaced-apart members for engagement against the muscles of the user, and wherein said frame members are formed with tubing.

11. The exercise device of claim 10, wherein said hand grips are located so that the exposed portion of said ball is between said hand grips and the body part to be exercised.

12. The exercise device of claim 10, wherein said frame further includes a transverse member with portions thereof defining said hand grips, and a midsection of said transverse member engaging a side of said ball opposite a side of the ball that is pushed against the user's body.

13. The exercise device of claim 10, wherein said ball is a rubber kick ball without structural modifications thereto.

14. The exercise device of claim 13, wherein an axis of said hand grips is parallel to a direction in which the exercise device is moved into engagement with the muscles of the user.

15. The exercise device of claim 12, wherein said frame includes a base member formed with said spaced-apart members, said spaced-apart members each having first ends joined together by a first side member, and said space-apart members having second ends joined together by a second side member, said spaced-apart members having a respective midsection with a curve for engagement with deformed portions on opposite sides of said ball, and further including a transverse member having opposing curved portions forming handles for said device, and a midsection of said transverse member having an outwardly curved portion for engagement with a side of said ball opposite a side of said ball that is pushed against muscles of the user, ends of said transverse member fastened to respective said side members of said base member.

16. The exercise device of claim 15, wherein the curved midsections of said spaced-apart members are angled toward each other to thereby cage said ball therebetween.

17. A method of exercising abdominal muscles of a person, comprising the steps of:

placing a deflated ball in a frame having spaced-apart members;

inflating the ball so that the ball balloons out from the spaced-apart frame members and forms two lobes, whereby the inflated ball is captured between the spaced-apart frame members and rotation of said ball is prevented;

grasping opposed handles of the frame;

pulling the exercise device toward the abdomen of the person so that one lobe of the ball engages the abdomen of the person; and causing the movement of the frame to compress the resilient ball against the abdomen of the person.

* * * * *